US010843231B2

(12) United States Patent
Stroup et al.

(10) Patent No.: US 10,843,231 B2
(45) Date of Patent: Nov. 24, 2020

(54) METHOD AND APPARATUS FOR APPLYING TENSION TO A SCREEN CLOTH ON A VIBRATING SCREENING MACHINE

(71) Applicant: Terex USA LLC, Westport, CT (US)

(72) Inventors: David Bryan Stroup, Burt, MI (US); Edwin J Sauser, Monticello, IA (US)

(73) Assignee: Terex USA, LLC, Westport, CT (US)

( * ) Notice: Subject to any disclaimer, the term of this patent is extended or adjusted under 35 U.S.C. 154(b) by 0 days.

(21) Appl. No.: 15/995,321

(22) Filed: Jun. 1, 2018

(65) Prior Publication Data

US 2018/0345321 A1 Dec. 6, 2018

Related U.S. Application Data

(60) Provisional application No. 62/513,649, filed on Jun. 1, 2017, provisional application No. 62/575,746, filed on Oct. 23, 2017.

(51) Int. Cl.
*B07B 1/48* (2006.01)

(52) U.S. Cl.
CPC ..... *B07B 1/48* (2013.01)

(58) Field of Classification Search
CPC ..... B07B 1/48; B07B 1/485; B07B 1/49
USPC ..... 209/403
See application file for complete search history.

(56) References Cited

U.S. PATENT DOCUMENTS 2,374,775 A * 5/1945 Parks ..... B07B 1/485 209/395
2,630,225 A * 3/1953 Bye ..... B07B 1/49 209/403
3,139,400 A * 6/1964 Kyle ..... B07B 1/48 209/403
4,816,153 A * 3/1989 Ando ..... B07B 1/48 209/319
4,846,352 A * 7/1989 Bailey ..... B07B 1/48 209/399
6,669,027 B1 * 12/2003 Mooney ..... B07B 1/48 209/399
2003/0066786 A1 * 4/2003 Seyffert ..... B07B 1/46 209/405
2006/0163121 A1 * 7/2006 Fisher ..... B01D 33/0376 209/399
2017/0320097 A1 * 11/2017 Meranda ..... B01D 33/0376

FOREIGN PATENT DOCUMENTS

DE 2461238 A1 * 6/1976 ..... B07B 1/48
DE 3825837 A1 * 1/1990 ..... B07B 1/48

OTHER PUBLICATIONS

Unified Screening & Crushing website: http://www.unifiedscreening.com/products/hooks_and_edge_prep—Product Page showing Hooks & Edge Prep—US-2 Shroud Banded Edges.

* cited by examiner

*Primary Examiner* — Terrell H Matthews
(74) *Attorney, Agent, or Firm* — Simmons Perrine Moyer Bergman PLC

(57) ABSTRACT

A variable resilience tension bar cap is disclosed for use in either, an end or side mounted tensioner in a vibrating screening machines used for material processing. A fluid filled hose or bladder may be disposed in a cap for a tensioner bar used to stretch wire cloth. Alternately a series of nested or replaceable resilient caps can be placed over the terminal end of a tensioner bar so that the cap is made to have a different resilience characteristics.

15 Claims, 7 Drawing Sheets

METHOD AND APPARATUS FOR APPLYING TENSION TO A SCREEN CLOTH ON A VIBRATING SCREENING MACHINE

CROSS REFERENCE TO RELATED APPLICATIONS

The present application claims the benefit of the filing date of provisional patent application having Ser. No. 62/513,649 filed on Jun. 1, 2017 and provisional patent application having Ser. No. 62/575,746 filed on Oct. 23, 2017, both by the same inventor, which applications are incorporated herein in their entirety by this reference.

FIELD OF THE INVENTION

The present invention generally relates to material processing, and more particularly relates to vibrating screening machines, and, even more particularly, relates to adjustably tensioned screen cloths or wire cloths on vibrating screening machines.

BACKGROUND OF THE INVENTION

In the past, various adjustably tensioned screening media or screen cloths have been used in a wide variety of applications primarily to limit slack induced contact between the screen cloth and paddles or cross-supports which span the width of the screen. In many of such designs, it was common to have a rotary or a side tensioner to apply a pulling force on curved end portions of the screen cloth.

While these types of adjustably tensioned systems may have many advantages in particular applications, they also have some drawbacks. For example, in many such vibrating screening machines, it is often not easy to quickly change the screening media or adjust the tension forces thereon, especially to objectively measurable levels of force. These systems are often too unforgiving and/or require higher skill levels and/or more physical strength than is possessed by some persons operating and/or monitoring the vibrating screening machines.

Consequently, there exists a need for improved methods and apparatuses for efficiently and definitively adjusting a tensioned screen cloth to an objectively measurable force levels.

SUMMARY OF THE INVENTION

It is an object of the present invention to provide an easily implemented system for applying a more uniform pulling force on a tensioned screen cloth.

It is a feature of the present invention to utilize interchangeable and replaceable tensioner bar caps, having different resiliency characteristics.

It is an advantage of the present invention to provide for a method and system for reducing slack induced internal movement of the screen cloth and contact between a screen cloth and paddles or lateral cross-supports on a vibrating screen.

It is another object of the present invention to provide an easily implemented system for applying a variable pulling force on a tensioned screen cloth.

It is another feature of the present invention to utilize tensioner bar caps, having variable resiliency characteristics.

It is an advantage of the present invention to provide for a method and system for adjusting and/or measuring tensioning forces applied to a screen cloth.

The present invention is an apparatus and method for efficiently and cost effectively providing the ability to easily measure and/or adjust tensioning force levels, which apparatus and method designed to satisfy the aforementioned needs, provide the previously stated objects, include the above-listed features, and achieve the already articulated advantages. The present invention is carried out in a "finesse-less" manner, in a sense that skill level, strength and attention to detail required to make proper slack reducing force level adjustments is greatly reduced.

Accordingly, the present invention is a method of improving operation of a material processing vibrating screening machine, comprising the steps of:

- providing a screening media configured to only allow particles having smaller size than a predetermined size to pass therethrough;
- providing a tensioner member, configured to be moved into various positions so as to apply a variable tension to said screening media; and
- providing first resilient matter, having a first resiliency characteristic, disposed between portions of said screening media and portions of said tensioner member, said first resilient matter being constructed and configured to at least partially conform to said portions of said screening media and thereby more evenly distribute, across said portions of said screening media, forces which are applied by said tensioner member.

Additionally, the present invention is a system for improving operation of a material processing vibrating screening machine comprising:

- screen media configured to only allow particles having smaller size than a predetermined size to pass therethrough;
- a tensioner member, configured to be moved into various positions so as to apply a variable tension to said screening media; and
- resilient matter, having a variable resiliency characteristic, disposed between portions of said screening media and portions of said tensioner member, said resilient matter being constructed and configured to at least partially conform to said portions of said screening media and thereby more evenly distribute, across said portions of said screening media, forces which are applied by said tensioner member.

Additionally, the present invention is a system for changing a resiliency characteristic of an interface between a screening media configured to only allow particles having smaller size than a predetermined size to pass therethrough and a tensioner member, configured to be moved into various positions so as to apply a variable tension to said screening media; where the system comprises:

- a plurality of molded tensioner caps where each of said plurality of molded tensioner caps is configured to securely fit over one of: a terminal portion of said tensioner member and another one of said plurality of molded tensioner caps.

BRIEF DESCRIPTION OF THE DRAWINGS

The invention may be more fully understood by reading the following description of the preferred embodiments of the invention, in conjunction with the appended drawings wherein.

DETAILED DESCRIPTION

Although described with particular reference to inclined multi-level end tensioned and side tensioned vibrating screens, the systems and methods, of the present invention, for applying and measuring tensioning forces to a screen cloth can be implemented in many different types of screen cloths and for many different vibrating screen applications.

In an embodiment, the system and method of the present invention described herein can be viewed as examples of many potential variations of the present invention which are protected hereunder.

Figure 1:
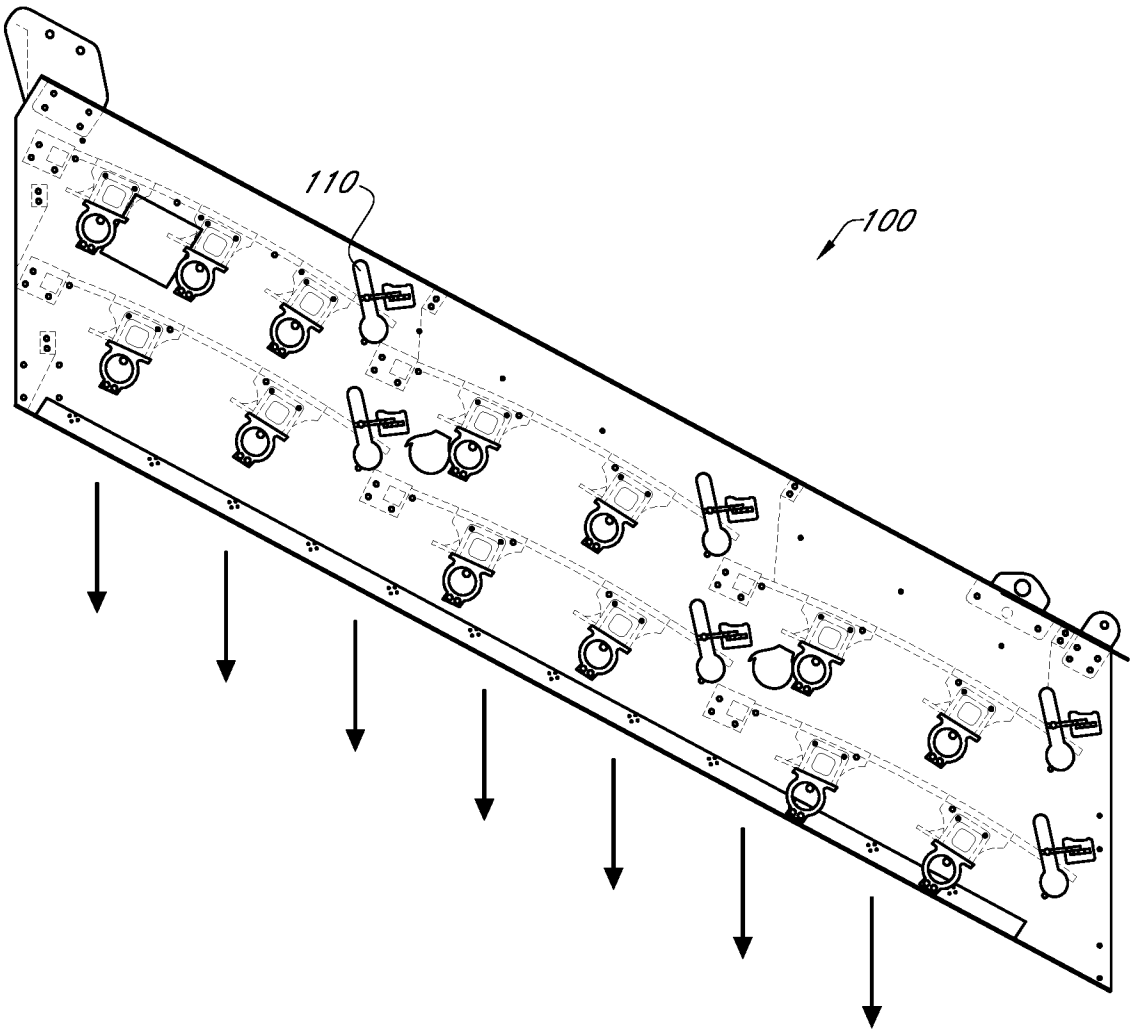
FIG. 1 (PRIOR ART)
FIG. 1 is a diagram illustrating a simplified vibrating screening machine of the prior art.

Now referring to the drawings wherein like numerals refer to like matter throughout and more particularly FIG. 1, there is shown a diagram illustrating a simplified version of just one vibrating screen 100 of the prior art. For the most part, these screens utilize vibration to agitate the mixture of aggregates to promote separation through various sized openings in the screening surfaces. Sorting is achieved by undersized particles passing through the openings in the screening surface with the oversize particles being retained and transported above the screen surface. Screens usually have some type of vibrating mechanism to shake the unit or shake the screen cloth itself. The screen 100 shown in FIG. 1 uses vibrating motors to shake the screen cloth at high frequency. This screen has six separate sections of screening surface. It can be considered an end tensioning system since the screen cloth is tensioned from one end to the other end of the screen. There are also side tensioned systems (FIGS. 3 and 4) where the screen cloth is tensioned from one side of the vibrating screen to the other side.

Figure 2:
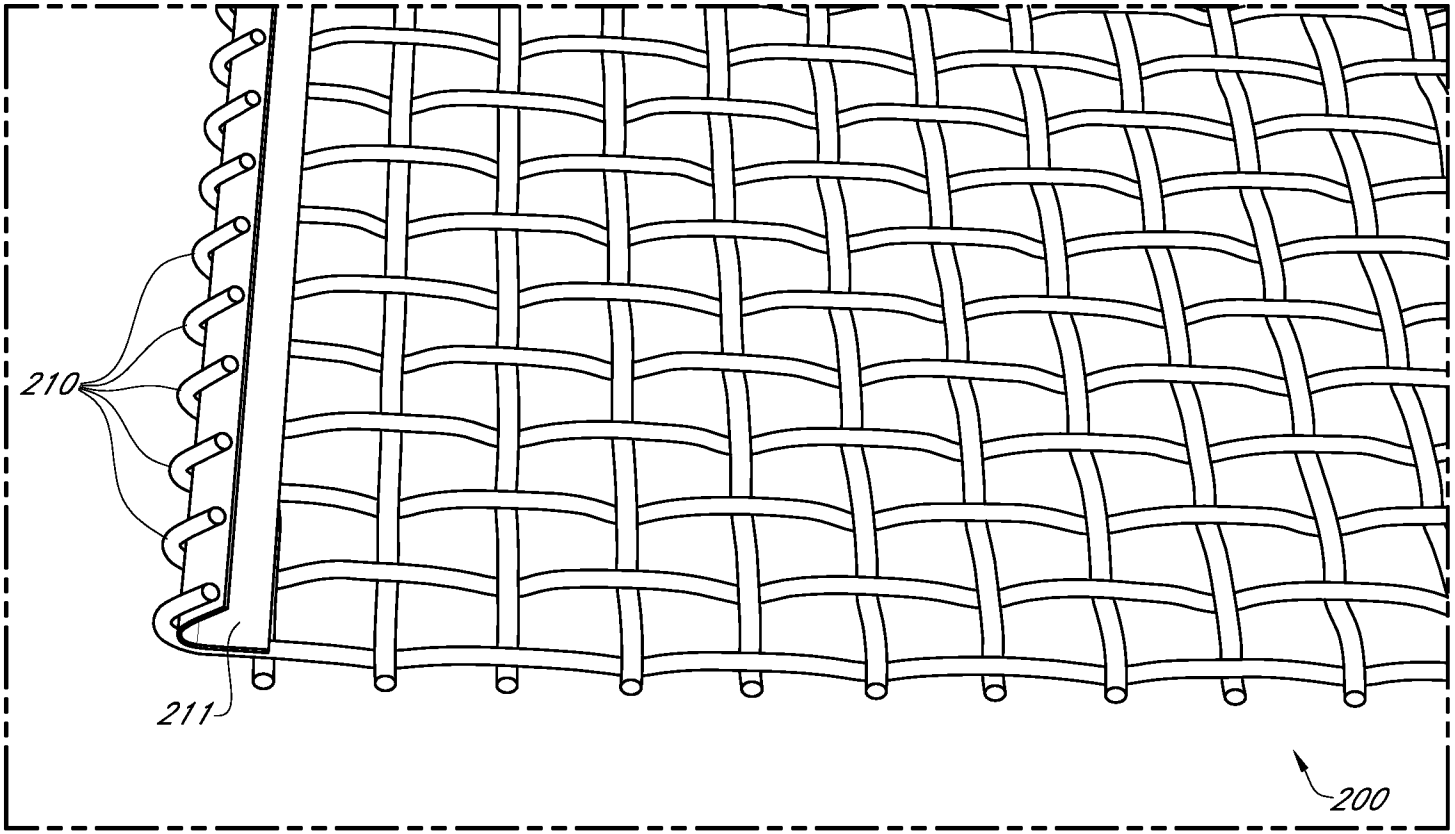
FIG. 2 (PRIOR ART)
FIG. 2 is a simplified diagram of a screen cloth of the prior art.

Now referring to FIG. 2, the screen cloth section 200 shown is representative of different members variations of members used to sort material. The screen cloths can be made of many different types of materials often consists of a mesh of various openings and of various wire sizes depending on the desired finished product. Notice the bent wire ends or bent hooks 210 and bent hook strip 211 located at the end of the wire mesh. The side and rotary tensioners described above have portions which engage these bent hooks 210 and/or the bent hook strip 211 to pull the cloth tight.

Figure 3:
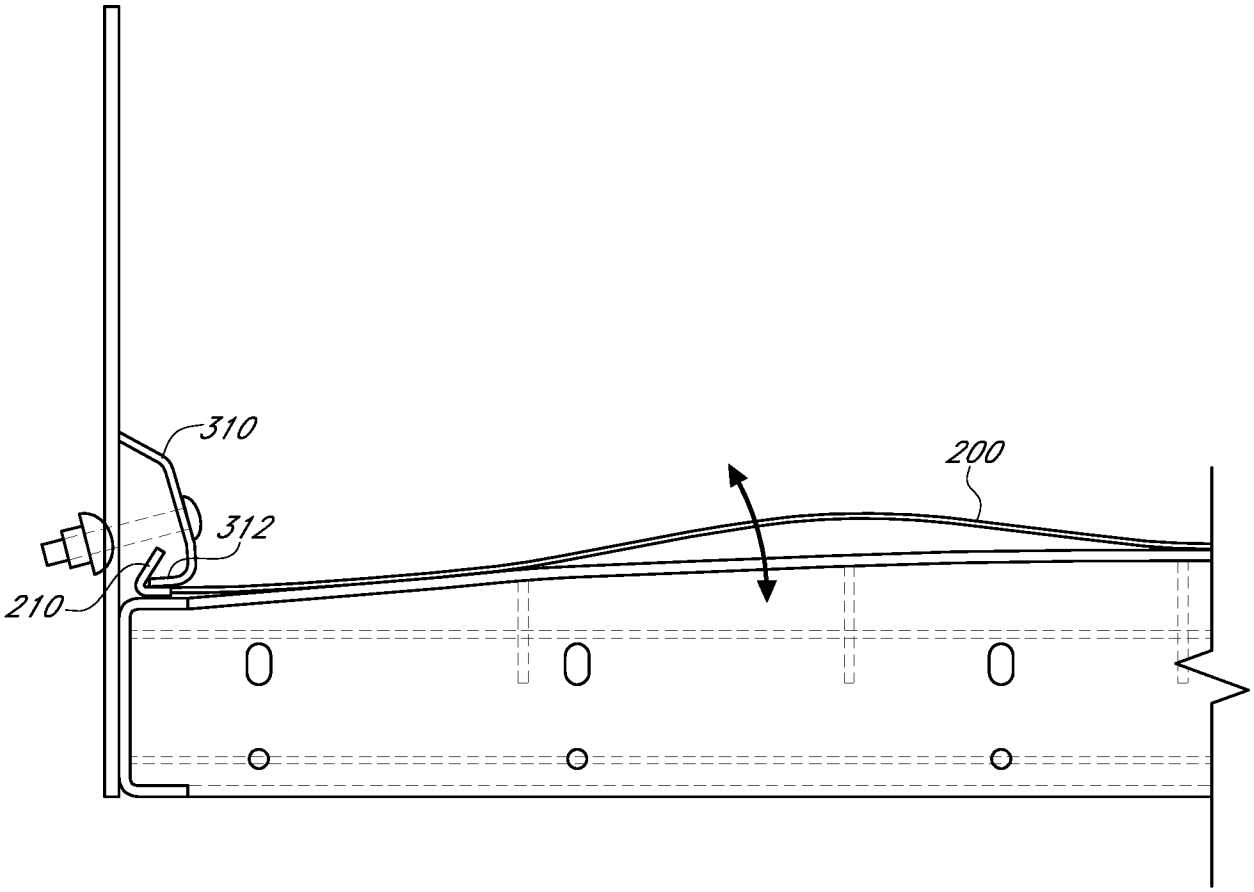
FIG. 3 (PRIOR ART)
FIG. 3 is a simplified diagram of a typical vibrating screening machine, of the prior art, with a side tensioned screen cloth.

Now referring to FIG. 3, there is shown a simplified representation of a portion of a vibrating screening machine of the prior art. One nature of a problem with the prior art is the uneven tensioning of the screen cloth which, over time, can cause premature failure of the screen cloth. It is possible that sections of cloth are over tightened causing over stress or sections that are too loose causing the wire cloth to flutter/flex and fatigue. FIG. 3 shows a common situation which allows the movement of the cloth due to the cloth not being tensioned properly.

Figure 4:
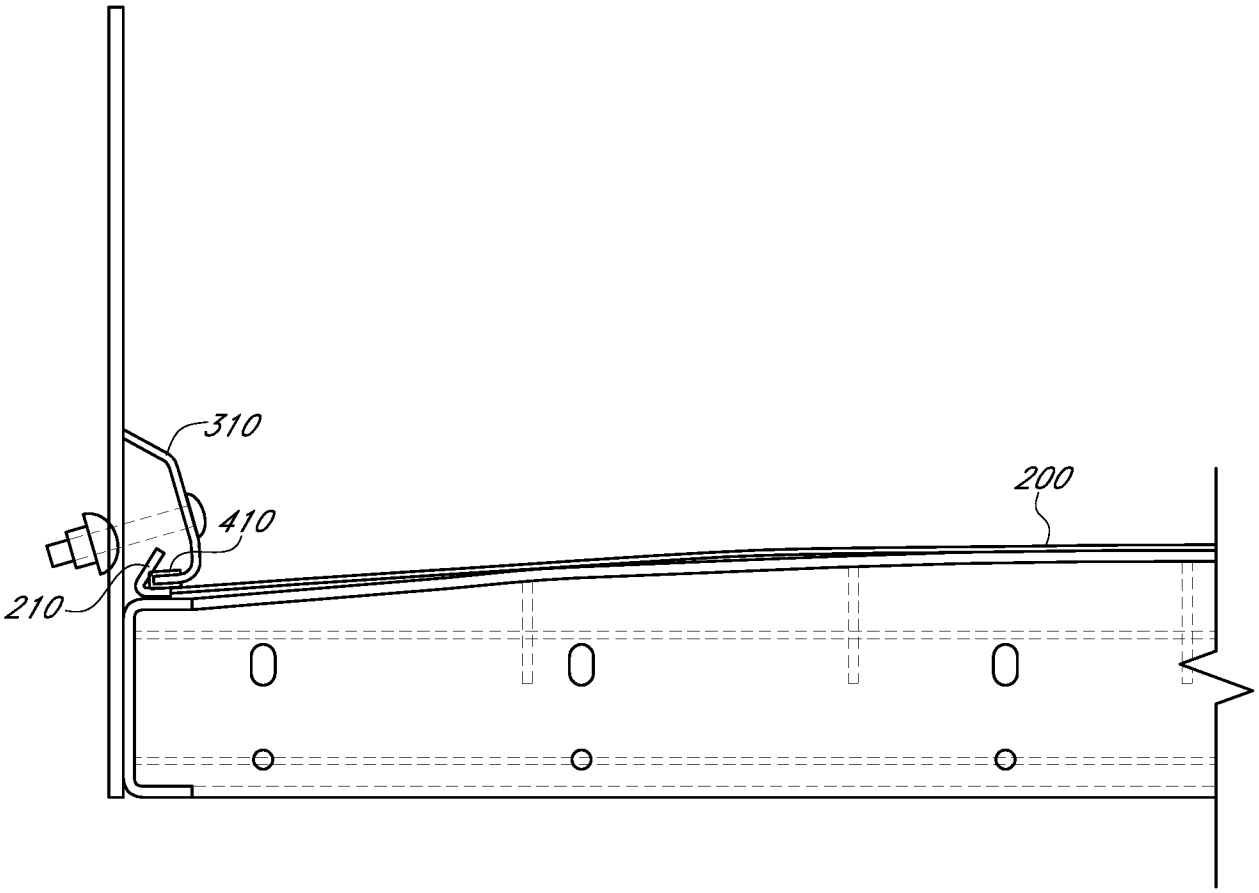
FIG. 4 is a simplified diagram of a side tensioning system of the present invention deployed in a vibrating screening machine of FIG. 3.

Now referring to FIG. 4, there is shown a representation of the present invention which is the same as FIG. 3 except for the addition of tensioner cap 410 and the fact that the cloth 200 is shown as being tensioned properly. Tensioner cap 410 is shown placed on the end 312 or edge of side tensioner rail 310. Tensioner cap 410 is resilient and may be made of rubber or suitable material. The idea behind the rubber tensioner cap 410 is to give even tensioning across the width of the cloth 200. The rubber tensioner cap 410 deforms to redistribute the wire tension, reducing high stress areas and allowing pressure to transfer to low pressure areas.

Because of the inclusion of the rubber tensioner cap 410, the cloth 200 has even pull and will not have the same tendency to be over stressed due to over tightening or loosening due to under tightening. The rubber tensioner cap 410 acts as a spring, keeping the cloth 200 tight when it is compressed. Because of the resilience of the tensioner cap 410, it at least partially conforms to the shape of the bent hooks 210, bent hook strip 211 etc. and reducing levels of uneven tensioning. This system will work with side or end tensioned decks.

Figure 5:
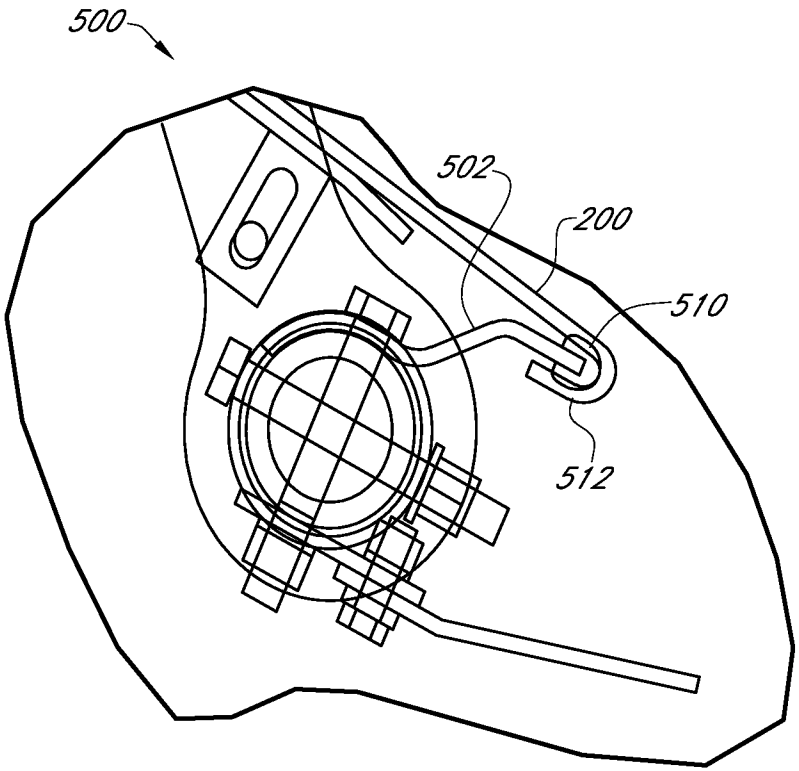
FIG. 5 is a view of an alternate embodiment of the present invention in relation to a rotary end tensioned screen cloth of FIG. 1.

Now referring to FIG. 5, there is shown the system of the present invention which is a close up view of a portion of FIG. 1 except for the addition of the tensioner cap 510.

Figure 6:
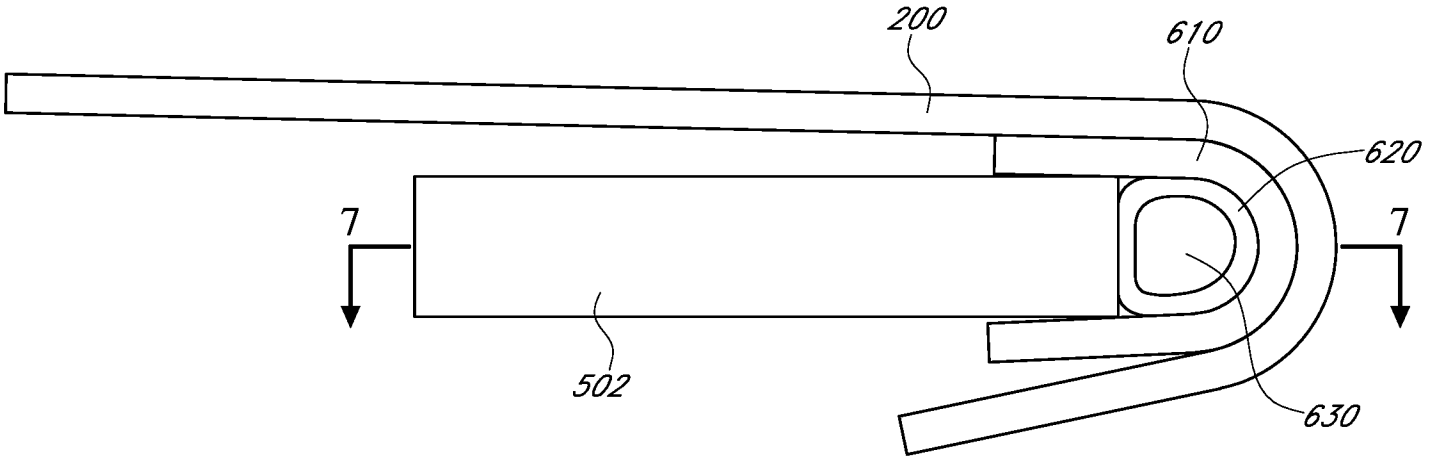
FIG. 6 is an alternate embodiment of the tensioner caps of FIGS. 4 and 5.
Figure 7:
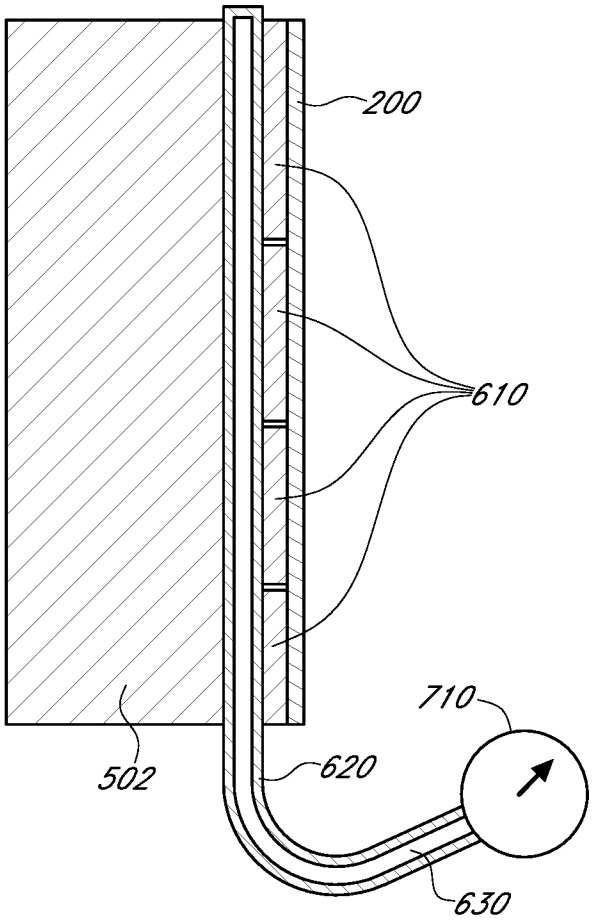
FIG. 7 is a cross-sectional view of the present invention, taken on line A-A of FIG. 6.

Now referring to FIGS. 6 and 7, where there is shown an alternate embodiment of the present invention which can be viewed as a variation of FIG. 5, and readily adapted to the system of FIG. 4.

The rubber cap 510 is removed from FIG. 5 and replaced with a tensioner cap 610, which could be segmented, or a single piece of rigid or semi rigid matter to mate with mesh cloth 200, bent hooks 210, or similar structure located an edge of a screening media and to transfer force between the mesh cloth 200 and the tensioner bar 502. A fluid 630 filled flexible hose 620 is disposed inside the tensioner cap 610 and between it and the tensioner bar 502. As the mesh cloth is tensioned to provide for better operation, the force between tensioner bar 502 and tensioner cap 610 is increased, which increases the pressure on the fluid 630. The pressure gauge/sensor 710 can be used to sense and/or report the fluid pressure in the hose 620. This can be used to indicate how much pressure is currently being applied to the wire cloth 200 and the strip 210.

In an alternate embodiment, the pressure in the hose 620 could be caused to increase by a pump (not shown) and pump controller (not shown) or by an accumulator (not shown) and valve (not shown) so as to intentionally cause the pressure on the wire cloth 200 to increase and decrease, respectively, and thereby provide for remote, fine or course, hydraulic or electronic/hydraulic tensioning adjustment capabilities. Multiple systems of hoses, tensioner caps, fluid, pumps, pump controllers, accumulators, valves, sensors and communication and control equipment could be provided for various portions of an automated remote controlled screen cloth tensioning apparatus.

The precise implementation of the present invention will vary depending upon the particular application.

It is thought that the method and apparatus of the present invention will be understood from the foregoing description and that it will be apparent that various changes may be made in the form, construct steps and arrangement of the parts and steps thereof without departing from the spirit and scope of the invention or sacrificing all of their material advantages. The form herein described is merely a preferred exemplary embodiment thereof.

We claim:

1. A method of improving operation of a material processing vibrating screening machine, comprising the steps of:

providing a screening media configured to only allow particles having smaller size than a predetermined size to pass therethrough;

providing a tensioner member, configured to be moved into various positions so as to apply a variable tension to said screening media; and providing first resilient matter, having a first resiliency characteristic, disposed between portions of said screening media and portions of said tensioner member, said first resilient matter being constructed and configured to at least partially conform to said portions of said screening media and thereby more evenly distribute, across said portions of said screening media, forces which are applied by said tensioner member.

2. The method of claim 1 further comprising the steps of:

determining that a change of an effective resiliency characteristic is desirable for matter disposed between said screening media and portions of said tensioner member; and changing said effective resiliency characteristic in response to said step of determining.

3. The method of claim 2 wherein said step of changing said effective resiliency characteristic comprises the steps of providing a second resilient matter with a second resiliency characteristic between said portions of said screening media and said tensioner member.

4. The method of claim 3 wherein said step of providing a second resilient matter is performed after performing a step of removing said first resilient matter from between said portions of said screening media and said portions of said tensioner member.

5. The method of claim 4 wherein said first resilient matter is a molded resilient member configured to fit over a terminal portion of said tensioner member.

6. The method of claim 2 wherein said first resilient matter comprises: a resilient vessel filled with a liquid.

7. The method of claim 6 wherein:

a. a pressure characteristic of said liquid is controllable and objectively measurable, in response to said step of determining; and b. said resilient vessel comprises one of a hose and a bladder.

8. A system for improving operation of a material processing vibrating screening machine comprising:

screen media configured to only allow particles having smaller size than a predetermined size to pass therethrough;

a tensioner member, configured to be moved into various positions so as to apply a variable tension to said screening media; and resilient matter, having a variable resiliency characteristic, disposed between portions of said screening media and portions of said tensioner member, said resilient matter being constructed and configured to at least partially conform to said portions of said screening media and thereby more evenly distribute, across said portions of said screening media, forces which are applied by said tensioner member.

9. The system of claim 8 wherein said resilient matter is a molded rubber member.

10. The system of claim 8 wherein said resilient matter comprises:

a. a resilient vessel;

b. a pressurized liquid disposed in said resilient vessel and causing said resilient vessel to change shape depending upon a level of pressure upon said pressurized liquid.

11. The system of claim 10 wherein said resilient vessel comprises one of a hose and a bladder.

12. The system of claim 11 further comprising a pressure indicator for reporting said level of pressure upon said pressurized liquid disposed in hose.

13. A system for changing a resiliency characteristic of an interface between a screening media configured to only allow particles having smaller size than a predetermined size to pass therethrough and a tensioner member, configured to be moved into various positions so as to apply a variable tension to said screening media; where the system comprises:

a plurality of molded tensioner caps where each of said plurality of molded tensioner caps is configured to securely fit over one of: a terminal portion of said tensioner member and another one of said plurality of molded tensioner caps.

14. The system of claim 13 wherein each of said plurality of molded tensioner caps are configured to be replacements for another of said plurality of molded tensioner caps.

15. The system of claim 13 wherein said plurality of molded tensioner caps are configured to nest upon each other.

* * * * *